US012577028B2

(12) United States Patent
Noda et al.

(10) Patent No.: US 12,577,028 B2
(45) Date of Patent: Mar. 17, 2026

(54) MOLDED PULP CUSHIONING MATERIAL

(71) Applicant: Sony Interactive Entertainment Inc., Tokyo (JP)

(72) Inventors: Takanori Noda, Kanagawa (JP); Atsunori Hamamoto, Tokyo (JP)

(73) Assignee: Sony Interactive Entertainment Inc., Tokyo (JP)

( * ) Notice: Subject to any disclaimer, the term of this patent is extended or adjusted under 35 U.S.C. 154(b) by 8 days.

(21) Appl. No.: 18/436,056

(22) Filed: Feb. 8, 2024

(65) Prior Publication Data

US 2024/0278971 A1 Aug. 22, 2024

(51) Int. Cl.

| | |
|---|---|
| ***B65D 81/02*** | (2006.01) |
| ***B65D 1/36*** | (2006.01) |
| ***B65D 1/42*** | (2006.01) |

(52) U.S. Cl.

CPC ..... *B65D 81/022* (2013.01); *B65D 1/36* (2013.01); *B65D 1/42* (2013.01)

(58) Field of Classification Search

CPC .... B65D 81/025; B65D 81/05; B65D 81/133; B65D 81/113; B65D 81/058; B65D 81/053; B65D 81/022; B65D 2585/6837; B65D 5/5069

USPC ..... 206/521, 592, 586, 320

See application file for complete search history.

(56) References Cited

U.S. PATENT DOCUMENTS

| | | | | |
|---|---|---|---|---|
| 6,405,873 | B2 * | 6/2002 | Koike | B65D 81/025 206/592 |
| 2009/0038978 | A1 * | 2/2009 | Lay | B65D 81/05 206/521 |
| 2011/0062040 | A1 | 3/2011 | Rich | |
| 2013/0240403 | A1 * | 9/2013 | Shih | B65D 81/058 206/591 |

FOREIGN PATENT DOCUMENTS

| | | | |
|---|---|---|---|
| JP | 2000153879 | A | 6/2000 |
| JP | 2019-182499 | A | 10/2019 |
| JP | 2021181311 | A | 11/2021 |

OTHER PUBLICATIONS

JP2023-025541, "Notice of Decision to Grant", Jul. 1, 2025, 3 pages.

* cited by examiner

*Primary Examiner* — King M Chu

(74) *Attorney, Agent, or Firm* — Kilpatrick Townsend & Stockton LLP

(57) ABSTRACT

Provided is a molded pulp cushioning material that allows at least a part of an accommodation target object having a first outer surface, two second outer surfaces, and two third outer surfaces to fit in a first direction and that includes a first wall and a second wall. First support protruding portions protruding in the first direction are formed on the first wall. Second support protruding portions are formed on the second wall. The first support protruding portions are lined up in the second direction and in the third direction. The second support protruding portions are lined up in the third direction. A distance between the two first support protruding (Continued)

portions adjacent to each other in the second direction and a distance between the two first support protruding portions adjacent to each other in the third direction are smaller than a distance between the two adjacent second support protruding portions.

10 Claims, 5 Drawing Sheets

MOLDED PULP CUSHIONING MATERIAL

CROSS-REFERENCE TO RELATED APPLICATION

This application claims the benefit of Japanese Priority Patent Application JP 2023-025541 filed Feb. 21, 2023, the entire contents of which are incorporated herein by reference.

BACKGROUND

The present disclosure relates to a molded pulp cushioning material.

When a product such as electronic equipment is transported, a cushioning material is used to protect the product. The product is placed in an outer box for transportation with a cushioning material attached to the outside of the product. A molding made from paper (molded pulp cushioning material) is sometimes used as the cushioning material. A molded pulp cushioning material is disclosed in Japanese Patent Laid-open No. 2019-182499.

SUMMARY

The molded pulp cushioning material supports a product or other accommodation target objects by using a plurality of protruding portions formed inside the molded pulp cushioning material. If the height of the protruding portions is great, the size of the outer box needs to be increased accordingly. This leads to a decrease in transportation efficiency. Therefore, there is a need for a cushioning material that provides sufficient cushioning function while reducing the height of the protruding portions.

According to an example of the present disclosure, there is provided a molded pulp cushioning material. The molded pulp cushioning material is configured to allow at least a part of an accommodation target object to fit in a first direction. The accommodation target object has a first outer surface, two second outer surfaces, and two third outer surfaces. The first outer surface faces in the first direction. The two second outer surfaces face each other in a second direction intersecting the first direction. The two third outer surfaces face each other in a third direction intersecting the first and second directions. The molded pulp cushioning material includes a first wall and a second wall. The first wall is provided to support the first outer surface of the accommodation target object. The second wall is provided to support one of the two second outer surfaces of the accommodation target object.

A plurality of first support protruding portions protruding in the first direction are formed on the first wall. A plurality of second support protruding portions are formed on the second wall. The plurality of first support protruding portions are lined up in the second direction and in the third direction. The plurality of second support protruding portions are lined up in the third direction. A distance between the two first support protruding portions adjacent to each other in the second direction and a distance between the two first support protruding portions adjacent to each other in the third direction are smaller than a distance between the two adjacent second support protruding portions.

According to another example of the present disclosure, there is provided a molded pulp cushioning material that accommodates at least a part of an accommodation target object. The accommodation target object has a first outer surface, two second outer surfaces, and two third outer surfaces. The first outer surface faces in a first direction. The two second outer surfaces face each other in a second direction intersecting the first direction. The two third outer surfaces face each other in a third direction intersecting the first and second directions. The molded pulp cushioning material includes a first wall and two third walls. The first wall is provided to support the first outer surface of the accommodation target object. The two third walls are provided to support the two third outer surfaces of the accommodation target object, and positioned to face each other in the third direction. A plurality of first support protruding portions protruding in the first direction are formed on the first wall. The plurality of first support protruding portions are lined up in the second direction and in the third direction. A third support protruding portion is formed on each of the two third walls. A width in the third direction of each of the plurality of first support protruding portions is smaller than 20% of a distance between the third support protruding portions formed on the two third walls.

According to still another example of the present disclosure, there is provided a molded pulp cushioning material that accommodates at least a part of an accommodation target object. The accommodation target object has a first outer surface, two second outer surfaces, and two third outer surfaces. The first outer surface faces in a first direction. The two second outer surfaces face each other in a second direction intersecting the first direction. The two third outer surfaces face each other in a third direction intersecting the first and second directions. The molded pulp cushioning material includes a first wall and a plurality of first support protruding portions. The first wall is provided to support the first outer surface of the accommodation target object. The plurality of first support protruding portions are formed on the first wall, and lined up in the second direction and in the third direction. A width of the first wall in the third direction is greater than a width of the first wall in the second direction. A width of each of the first support protruding portions in the third direction is equal to or smaller than a width of each of the first support protruding portions in the second direction.

DETAILED DESCRIPTION OF THE PREFERRED EMBODIMENT

A molded pulp cushioning material proposed in an embodiment of the present disclosure will now be described with reference to the accompanying drawings. In the description of the present disclosure, molded pulp cushioning materials 10A and 10B are used as examples of the present disclosure.

Figure 1:
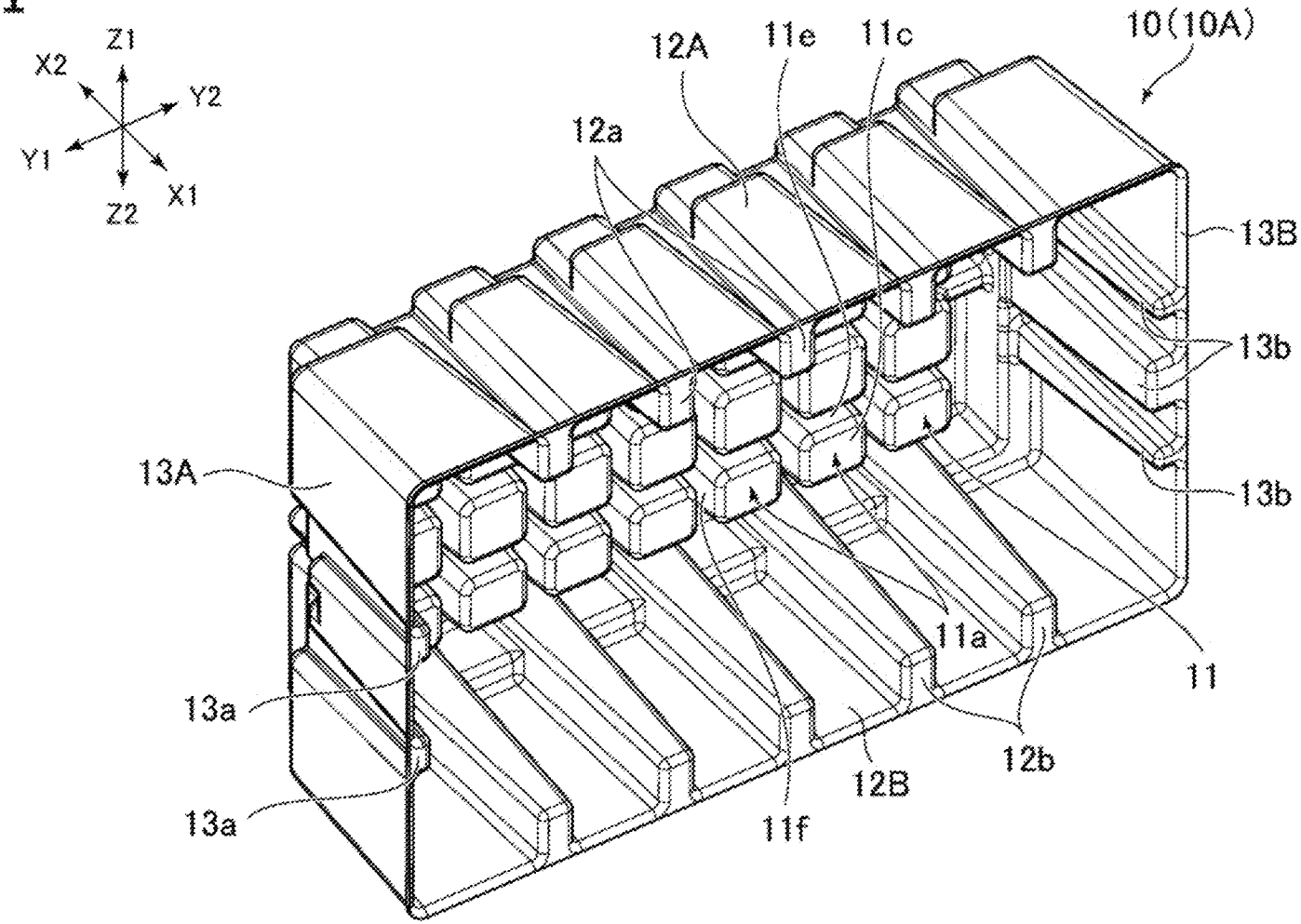
FIG. 1 is a perspective view of an example of a molded pulp cushioning material proposed in an embodiment of the present disclosure.

Z1 and Z2 directions depicted, for example, in FIG. 1 are hereinafter referred to as the upward and downward directions, respectively. Further, X1 and X2 directions depicted in FIG. 1 are hereinafter referred to as the rightward and leftward directions, respectively. Moreover, Y1 and Y2 directions are hereinafter referred to as the forward and rearward directions, respectively. These directions are defined in order to describe the shapes of the elements (portions) of the molded pulp cushioning material and their relative positions. Therefore, the directions depicted in the drawings do not limit the posture of a molded pulp cushioning material 10 during use. In the following description, the molded pulp cushioning material is simply referred to as the "cushioning material."

Figure 3:
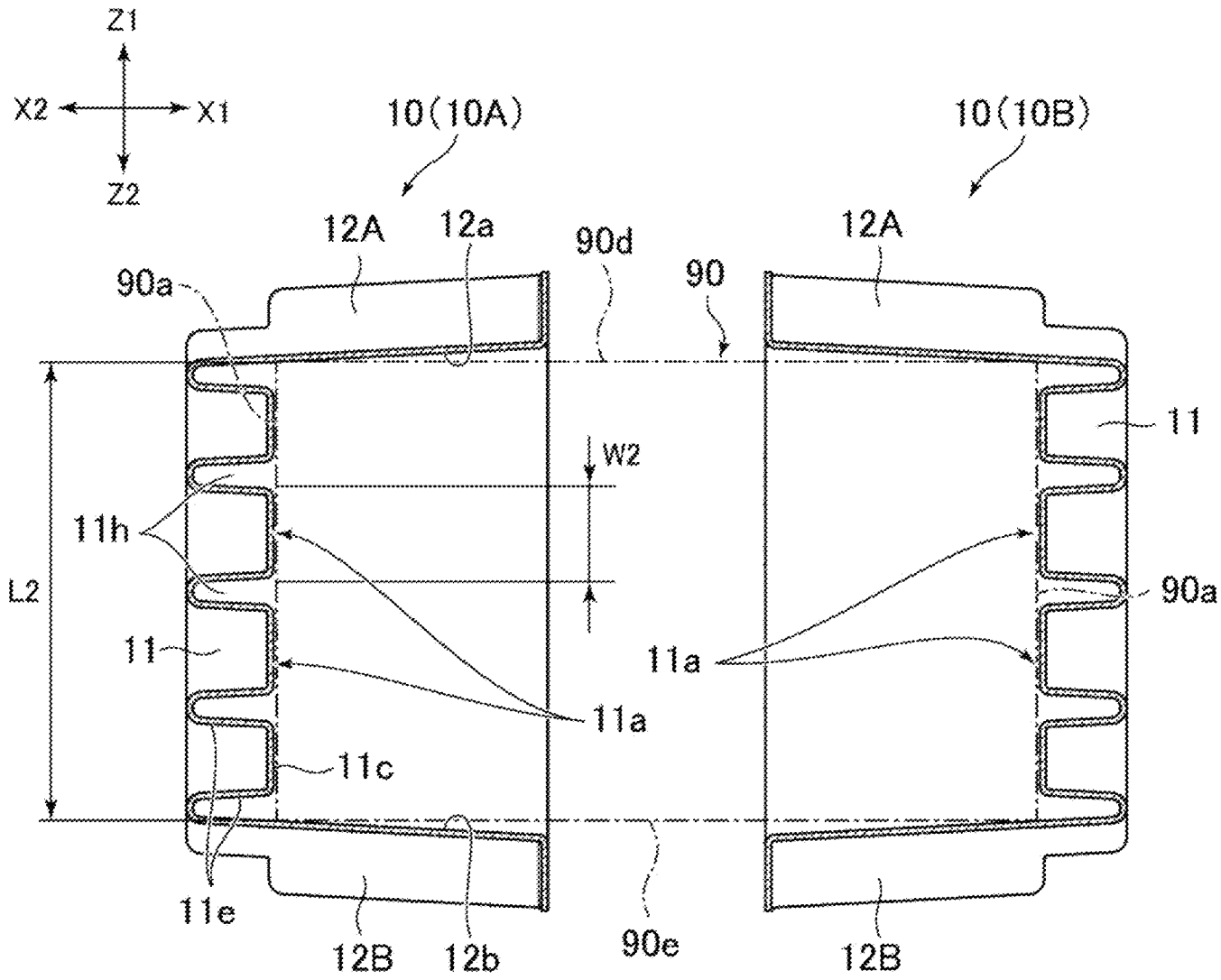
FIG. 3 is a cross-sectional view of the molded pulp cushioning material during use taken along line III-III depicted in FIG. 2A.
Figure 4:
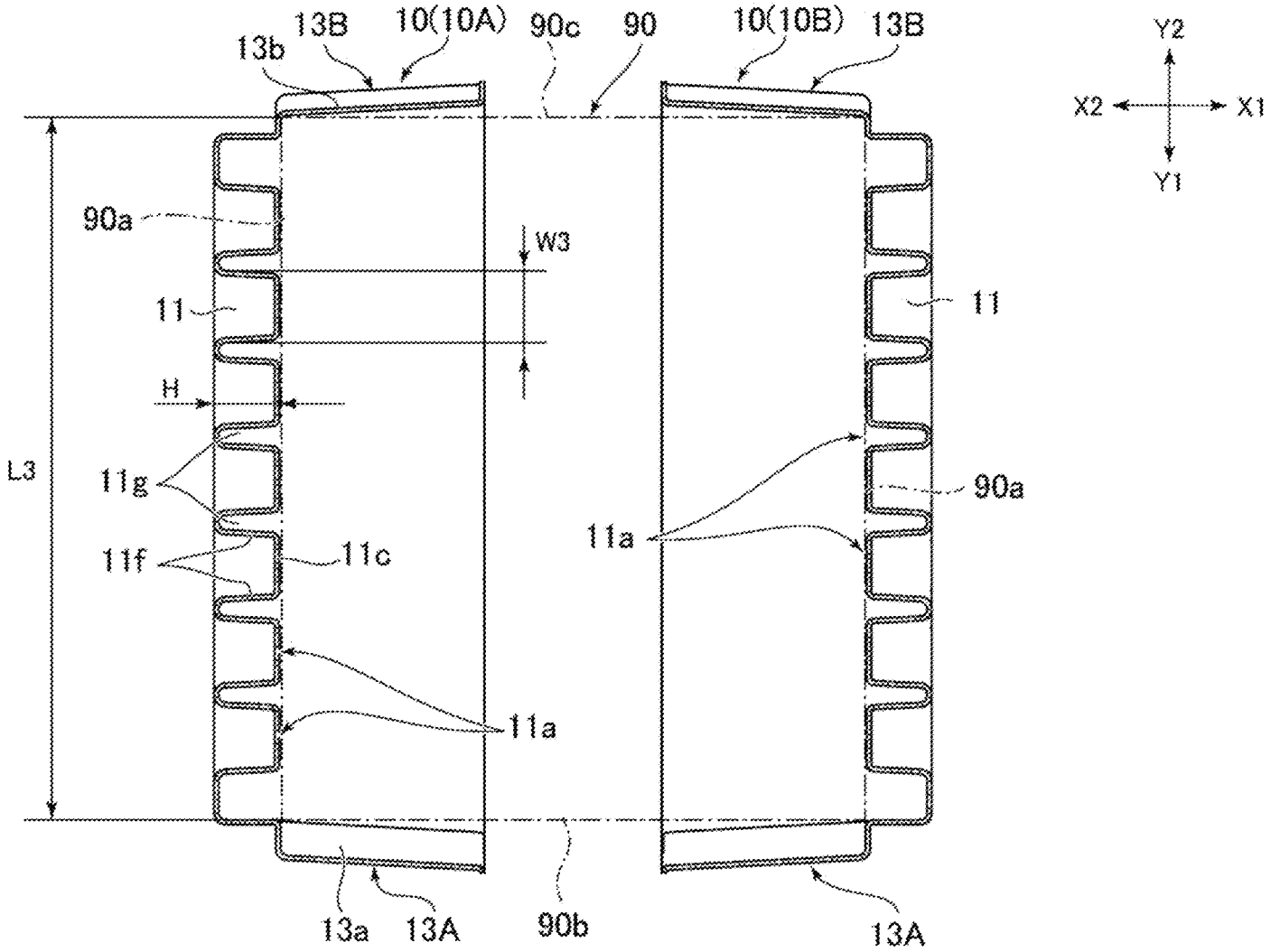
FIG. 4 is a cross-sectional view of the molded pulp cushioning material during use taken along line IV-IV depicted in FIG. 2A.

As depicted in FIGS. 3 and 4, the cushioning materials 10A and 10B are configured to accommodate a left or right portion of an accommodation target object 90 when in use. In the process of transporting the accommodation target object 90, the two cushioning materials 10A and 10B are used. The two cushioning materials 10A and 10B accommodate the left and right portions of the accommodation target object 90, respectively. The cushioning materials 10A and 10B are not always used in such a manner. The cushioning materials 10A and 10B may be configured to accommodate the whole of the accommodation target object.

In the following description that does not distinguish between the two cushioning materials 10A and 10B, the cushioning materials 10A and 10B are denoted by the reference sign "10."

The accommodation target object 90 is, for example, electronic equipment. The electronic equipment is, for example, entertainment equipment that functions as a gaming device or an audio-visual device. The electronic device may be a personal computer or a server computer. When the cushioning material 10 is used, it is attached to the accommodation target object 90 and housed together with the accommodation target object 90 in an outer box (not depicted) for transportation.

As depicted in FIG. 1, the cushioning material 10 is shaped like a box that is open toward one side in the left-right direction. As depicted in FIG. 3, the cushioning material 10 (10A) for accommodating the left portion of the accommodation target object 90 is open toward the right side, and the cushioning material 10 (10B) for accommodating the right portion of the accommodation target object 90 is open toward the left side. The structures of these two cushioning materials 10 may be left-right symmetric or may be asymmetric depending on the external shape of the accommodation target object 90.

As depicted in FIG. 1, the cushioning material 10 has a side wall 11 that faces and supports a side surface 90*a* (see FIG. 3) of the accommodation target object 90. Further, the cushioning material 10 has an upper wall 12A, a lower wall 12B, a front wall 13A, and a rear wall 13B.

The upper wall 12A, the lower wall 12B, the front wall 13A, and the rear wall 13B each extend from the edge of the side wall 11 toward one side in the left-right direction. That is, in the cushioning material 10 (10A; see FIG. 3) that accommodates the left portion of the accommodation target object 90, the walls 12A, 12B, 13A, and 13B extend rightward from the edge of the side wall 11. In the cushioning material 10 (10B; see FIG. 3) that accommodates the right portion of the accommodation target object 90, the walls 12A, 12B, 13A, and 13B extend leftward from the edge of the side wall 11. The upper wall 12A and the lower wall 12B respectively face and support an upper surface 90*d* and a lower surface 90*e* (see FIG. 3) of the accommodation target object 90. The front wall 13A and the rear wall 13B respectively face and support a front surface 90*b* and a rear surface 90*c* (see FIG. 4) of the accommodation target object 90.

Figure 2A:
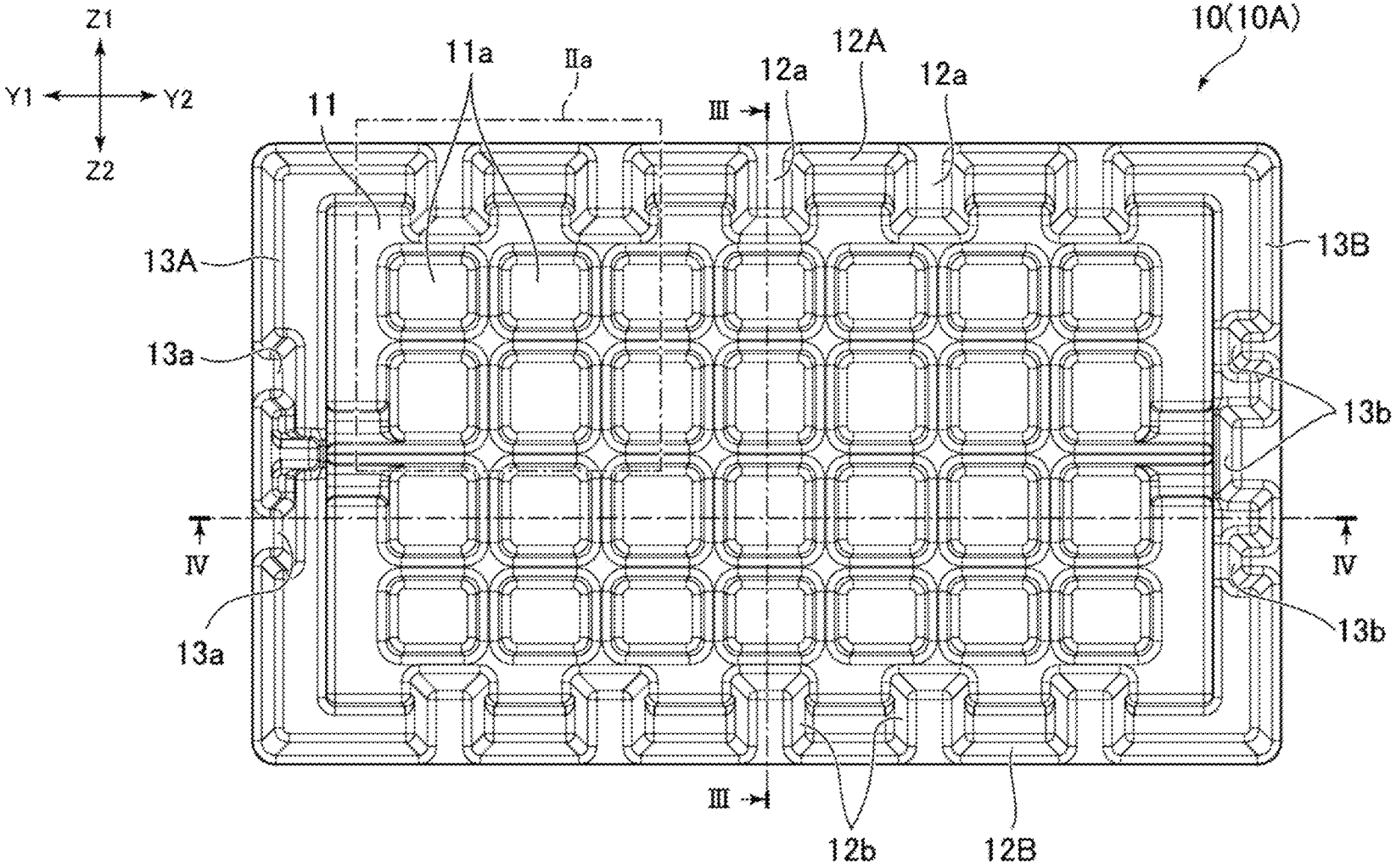
FIG. 2A is a side view of the molded pulp cushioning material depicted in FIG. 1.

As depicted in FIG. 2A, the width of an accommodation space inside the cushioning material 10 in the front-rear direction (the distance between later-described third support protruding portions 13*a* and 13*b*) is greater than the width of the accommodation space inside the cushioning material 10 in the up-down direction (the distance between later-described second support protruding portions 12*a* and 12*b*).

The cushioning material 10 is a molding made from paper (e.g., wastepaper), and is integrally molded. That is, the walls 11, 12A, 12B, 13A, and 13B are neither formed by bending two adjacent walls nor interconnected with adhesive applied to the walls 11, 12A, 12B, 13A, and 13B.

As depicted in FIG. 1, a plurality of first support protruding portions 11*a* for supporting the side surface 90*a* of the accommodation target object 90 are formed on the side wall 11. The first support protruding portions 11*a* protrude toward the inside of the cushioning material 10 (i.e., protrude toward the side surface 90*a* of the accommodation target object 90). An apex 11*c* of each of the first support protruding portions 11*a* supports the side surface 90*a* of the accommodation target object 90. That is, the apex 11*c* comes into contact with the side surface 90*a*.

On the outside of the cushioning material 10, the first support protruding portions 11*a* are recessed. Hence, the first support protruding portions 11*a* have support walls 11*e* and 11*f* (see FIGS. 3 and 4) that are formed on the edge of the apex 11*c* and extended outward in the left-right direction from the apex 11*c*.

As depicted in FIG. 2A, the plurality of first support protruding portions 11*a* are lined up in two directions, namely, the up-down direction (Z1-Z2 direction) and the front-rear direction (Y1-Y2 direction). The first support protruding portions 11*a* constitute a plurality of rows and a plurality of columns. The first support protruding portions 11*a* in each row are lined up in the front-rear direction. The first support protruding portions 11*a* in each column are lined up in the up-down direction.

Figure 2B:
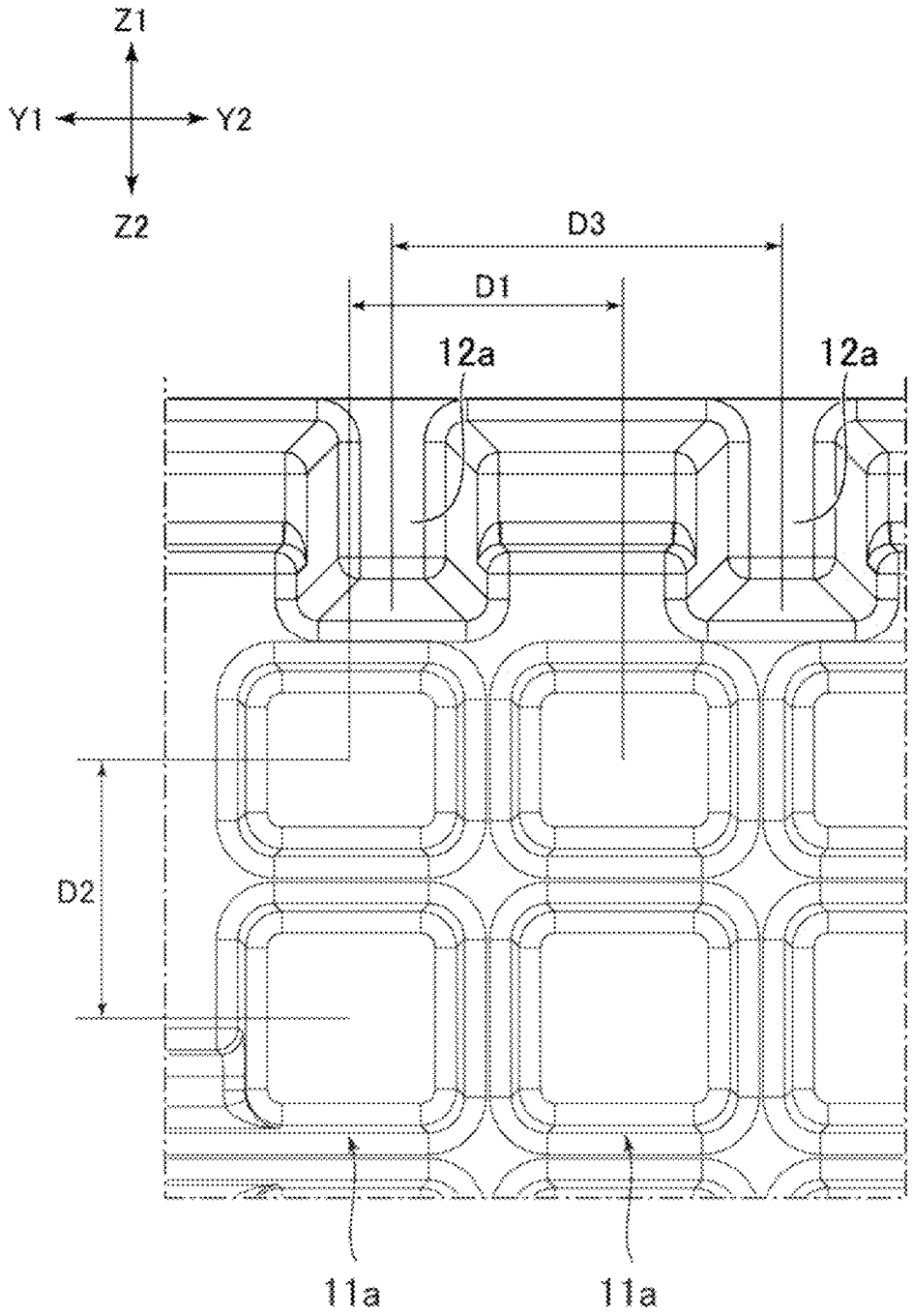
FIG. 2B is an enlarged view of a region IIb depicted in FIG. 1.

In the examples depicted in FIGS. 2A and 2B, the side wall 11 has four rows and seven columns. However, the number of rows and the number of columns need not necessarily be four and seven, respectively. That is, the number of rows may be smaller than four or larger than four. Similarly, the number of columns may be smaller than seven or larger than seven. Further, the number of rows and the number of columns may vary with regions of the side wall 11 (e.g., may vary from a front region to a rear region).

As depicted in FIG. 1, a plurality of second support protruding portions 12*a* are formed on the upper wall 12A and lined up in the front-rear direction, and a plurality of second support protruding portions 12*b* are formed on the lower wall 12B and lined up in the front-rear direction. The second support protruding portions 12*a* of the upper wall 12A and the second support protruding portions 12*b* of the lower wall 12B may be arranged symmetrically or arranged asymmetrically. The second support protruding portions 12*a* and 12*b* protrude toward the inside of the cushioning material 10. More specifically, the second support protruding portions 12*a* of the upper wall 12A protrude downward, and the second support protruding portions 12*b* of the lower wall 12B protrude upward. An apex of each of the second support protruding portions 12*a* and 12*b* supports the outer surface (the upper surface 90*d* and the lower surface 90*e*, respectively) of the accommodation target object 90.

Each of the second support protruding portions 12*a* and 12*b* is shaped like a pillar and extended in the left-right direction. The second support protruding portions 12*a* and 12*b* may be extended, for example, from one end (the opening edge of the cushioning material 10) in the left-right direction of the upper wall 12A and the lower wall 12B toward the opposite end (the end closer to the side wall 11).

As depicted in FIG. 1, a plurality of third support protruding portions 13*a* are formed on the front wall 13A and lined up in the up-down direction. Similarly, a plurality of third support protruding portions 13*b* are formed on the rear wall 13B and lined up in the up-down direction. The third support protruding portions 13*a* of the front wall 13A and the third support protruding portions 13*b* of the rear wall 13B may be arranged symmetrically or arranged asymmetrically. The third support protruding portions 13*a* and 13*b* protrude toward the inside of the cushioning material 10. More specifically, the third support protruding portions 13*a* of the front wall 13A protrude rearward, and the third support protruding portions 13*b* of the rear wall 13B protrude forward. An apex of each of the third support protruding portions 13*a* and 13*b* supports the outer surface (the front surface 90*b* or the rear surface 90*c*) of the accommodation target object 90.

The third support protruding portions 13*a* and 13*b* are extended in the left-right direction. The third support protruding portions 13*a* and 13*b* may be extended, for example, from one end (the opening edge of the cushioning material 10) in the left-right direction of the front wall 13A and the rear wall 13B toward the opposite end.

As depicted in FIG. 2B, two first support protruding portions 11*a* adjacent to each other in the front-rear direction are separated from each other by a distance D1. Further, two first support protruding portions 11*a* adjacent to each other in the up-down direction are separated from each other by a distance D2. Two second support protruding portions 12*a* adjacent to each other in the front-rear direction are separated from each other by a distance D3.

It should be noted that the distance D1 is, for example, the distance in the front-rear direction between the centers of the adjacent first support protruding portions 11*a*. Similarly, the distance D2 may be, for example, the distance in the up-down direction between the centers of the adjacent first support protruding portions 11*a*. The distance D3 may be, for example, the distance in the front-rear direction between the centers of the adjacent second support protruding portions 12*a*.

As depicted in FIG. 2B, the distance D1 and the distance D2 are smaller than the distance D3. Since the first support protruding portions 11*a* are arranged in the above-described manner, the number of first support protruding portions 11*a* can be increased to improve the shock absorption performance of the side wall 11, which is more susceptible to external shock than the upper wall 12A and the lower wall 12B. As a result, the thickness of the side wall 11 (e.g., the height of the first support protruding portions 11*a* in the left-right direction) can be decreased to reduce the size of the outer box.

The distance D1 and the distance D2 may be smaller than half the distance D3. When the first support protruding portions 11*a* are arranged in such a manner, the number of first support protruding portions 11*a* can be further increased to further improve the shock absorption performance of the side wall 11.

As depicted in FIG. 4, each of the first support protruding portions 11*a* has a width W3 in the front-rear direction. The front wall 13A and the rear wall 13B have the third support protruding portions 13*a* and 13*b*, respectively. The third support protruding portions 13*a* formed on the front wall 13A and the third support protruding portions 13*b* formed on the rear wall 13B are separated from each other by a distance L3. The width W3 of the first support protruding portions 11*a* may be smaller than 20% of the distance L3.

As described above, the width in the front-rear direction (Y1-Y2 direction) of the accommodation space inside the cushioning material 10, that is, the distance L3 between the third support protruding portions 13*a* and 13*b*, is greater than the width in the up-down direction of the accommodation space inside the cushioning material 10, that is, a distance L2 between the second support protruding portions 12*a* and 12*b* (see FIG. 3). As depicted in FIG. 4, when the width W3 of the first support protruding portions 11*a* is made smaller than 20% of the distance L3, a sufficient number of first support protruding portions 11*a* can be reserved in the direction in which there is a great width (front-rear direction). It should be noted that the width W3 of some of the first support protruding portions 11*a* formed on the side wall 11 may be outside the range described here (smaller than 20% of the distance L3).

The width W3 of the first support protruding portions 11*a* may be smaller than 15% of the distance L3. In such a case, a larger number of first support protruding portions 11*a* can be reserved in the front-rear direction. More preferably, the width W3 of the first support protruding portions 11*a* may be smaller than 10% of the distance L3.

The width W3 of the first support protruding portions 11*a* may be 5% or more of the distance L3. If the first support protruding portions 11*a* are excessively small, it becomes difficult to mold the first support protruding portions 11*a*. When the width W3 of the first support protruding portions 11*a* is 5% or more of the distance L3, the first support protruding portions 11*a* can easily be molded.

As depicted in FIG. 4, a groove 11*g* is formed between two first support protruding portions 11*a* adjacent to each other in the front-rear direction. The width of the groove 11*g* is smaller than the width W3 of the first support protruding portions 11*a*. This makes it easy to reserve a sufficient number of first support protruding portions 11*a* in the front-rear direction of the cushioning material 10. The width of the groove 11*g* in the front-rear direction may be smaller than half the width W3 of the first support protruding portions 11*a*. In such a case, it is even easier to reserve a sufficient number of first support protruding portions 11*a*.

As depicted in FIG. 3, each of the first support protruding portions 11*a* has a width W2 in the up-down direction. The upper wall 12A and the lower wall 12B have the second support protruding portions 12*a* and 12*b*, respectively. The second support protruding portions 12*a* formed on the upper wall 12A and the second support protruding portions 12*b* formed on the lower wall 12B are separated from each other by the distance L2. The width W2 of the first support protruding portions 11*a* may be smaller than 30% of the distance L2. In such a case, a sufficient number of first support protruding portions 11*a* can be reserved not only in the front-rear direction but also in the up-down direction. It should be noted that the width W2 of some of the first support protruding portions 11*a* formed on the side wall 11 may be outside the range described here (smaller than 30% of the distance L2).

The width W2 of the first support protruding portions 11*a* may be smaller than 25% of the distance L2. In such a case, a larger number of first support protruding portions 11*a* can be reserved in the up-down direction. More preferably, the width W2 of the first support protruding portions 11*a* may be smaller than 20% of the distance L2.

The width W2 of the first support protruding portions 11*a* may be 5% or more of the distance L2. If the first support protruding portions 11*a* are excessively small, it becomes difficult to mold the first support protruding portions 11*a*. When the width W2 of the first support protruding portions 11*a* is 5% or more of the distance L2, the first support protruding portions 11*a* can easily be molded.

As depicted in FIG. 3, a groove 11*h* is formed between the first support protruding portions 11*a* adjacent to each other in the up-down direction. The width of the groove 11*h* in the up-down direction is smaller than the width W2 of the first support protruding portions 11*a*. This makes it easy to reserve a sufficient number of first support protruding portions 11*a* in the up-down direction of the cushioning material 10. The width of the groove 11*h* in the up-down direction may be smaller than half the width W2 of the first support protruding portions 11*a*. In such a case, it is even easier to reserve a sufficient number of first support protruding portions 11*a*.

The width W2 in the up-down direction of each of the first support protruding portions 11*a* (see FIG. 3) and the width W3 in the front-rear direction of each of the first support protruding portions 11*a* (see FIG. 4) may be, for example, within the range between 0.5 and 3.0 cm. The widths W2 and W3 may preferably be within the range between 1.0 and 2.5 cm. The width of the groove 11*g* between the first support protruding portions 11*a* adjacent to each other in the front-rear direction and the width of the groove 11*h* between the first support protruding portions 11*a* adjacent to each other in the up-down direction may be smaller than the widths W2 and W3. In such a case, an adequate number of first support protruding portions 11*a* can be reserved in both the front-rear direction and the up-down direction.

It should be noted that the width W2 in the up-down direction may vary in at least one of the front-rear direction and the up-down direction of the cushioning material 10. For example, the width W2 may gradually become smaller from the front end to the rear end of the cushioning material 10. Similarly, the width W3 in the front-rear direction may vary in at least one of the front-rear direction and the up-down direction of the cushioning material 10.

As another alternative, the widths W2 and W3 may vary with the regions of the side wall 11 (e.g., may vary from the front region to the rear region). For example, the width W2 (or the width W3) of the first support protruding portions 11*a* in the front region may be different from the width W2 (or the width W3) of the first support protruding portions 11*a* in the rear region. Further, the widths W2 and W3 of some of the first support protruding portions 11*a* may be outside the above-mentioned range (0.5 to 4.0 cm).

As depicted in FIG. 2A, the width in the front-rear direction of the side wall 11, on which the plurality of first support protruding portions 11*a* are formed, is greater than the width in the up-down direction of the side wall 11. Meanwhile, the width W3 (see FIG. 4) in the front-rear direction of the first support protruding portions 11*a* and the width W2 (see FIG. 3) in the up-down direction of the first support protruding portions 11*a* may be substantially the same. Alternatively, the width W3 may be smaller than the width W2 in the up-down direction.

Consequently, a sufficient number of first support protruding portions 11*a* can easily be reserved in the front-rear direction when compared to a case, for example, where the width W3 is to be made greater than the width W2 according to the shape of the side wall 11 (the width in the front-rear direction is greater than the width in the up-down direction). As mentioned earlier, the width of the groove 11*g* (see FIG. 4) between the first support protruding portions 11*a* adjacent to each other in the front-rear direction is smaller than the width W3 in the front-rear direction. Accordingly, it is even easier to reserve a sufficient number of first support protruding portions 11*a* in the front-rear direction.

As depicted in FIGS. 3 and 4, each of the first support protruding portions 11*a* has a height H in the left-right direction. The width W3 in the front-rear direction and the width W2 in the up-down direction may be greater than the height H. This ensures that the first support protruding portions 11*a* can easily be molded.

(1) An example of the molded pulp cushioning material proposed in the present disclosure is configured to allow at least a part of the accommodation target object to fit in a first direction. The accommodation target object has a first outer surface, two second outer surfaces, and two third outer surfaces. The first outer surface faces in the first direction. The two second outer surfaces face each other in a second direction intersecting the first direction. The two third outer surfaces face each other in a third direction intersecting the first and second directions. This molded pulp cushioning material includes a first wall and a second wall. The first wall is provided to support the first outer surface of the accommodation target object. The second wall is provided to support one of the two second outer surfaces of the accommodation target object. The plurality of first support protruding portions protruding in the first direction are formed on the first wall. The plurality of second support protruding portions are formed on the second wall. The plurality of first support protruding portions are lined up in the second direction and in the third direction. The plurality of second support protruding portions are lined up in the third direction. A distance between the two first support protruding portions adjacent to each other in the second direction and a distance between the two first support protruding portions adjacent to each other in the third direction are smaller than a distance between the two adjacent second support protruding portions. The above-described molded pulp cushioning material makes it possible to increase the number of first support protruding portions. As a result, the height of the first support protruding portions can be reduced while the shock absorption performance acting in the first direction is ensured.

(2) The molded pulp cushioning material described in (1) is configured such that the distance between the two first support protruding portions adjacent to each other in the second direction and the distance between the two first support protruding portions adjacent to each other in the third direction are smaller than half the distance between the two adjacent second support protruding portions. This configuration makes it possible to form a larger number of first support protruding portions.

(3) The molded pulp cushioning material described in (1) or (2) further includes two third walls that face each other in the third direction to respectively support the two third outer surfaces of the accommodation target object. A third support protruding portion is formed on each of the two third walls. A width in the third direction of each of the plurality of first support protruding portions is smaller than 20% of a distance between the third support protruding portions formed on the two third walls. The molded pulp cushioning material having the above-described configuration makes it possible to further increase the number of first support protruding portions lined up in the third direction.

(4) The molded pulp cushioning material described in any one of (1) to (3) further includes two second walls that face each other in the second direction to respectively support the two third outer surfaces of the accommodation target object. A second support protruding portion is formed on each of the two second walls. A width in the second direction of each of the plurality of first support protruding portions is smaller than 30% of a distance between the second support protruding portions formed on the two second walls. The molded pulp cushioning material having the above-described configuration makes it possible to further increase the number of first support protruding portions lined up in the second direction.

(5) The molded pulp cushioning material described in any one of (1) to (4) is configured such that a width of the first wall in the third direction is greater than a width of the first wall in the second direction. A width of each of the first support protruding portions in the third direction may be equal to or smaller than a width of each of the first support protruding portions in the second direction. This configuration makes it possible to further increase the number of first support protruding portions in the third direction.

(6) The molded pulp cushioning material described in any one of (1) to (5) is configured such that a groove is formed between the two first support protruding portions adjacent to each other in the third direction. A width of the groove may be smaller than the width in the third direction of each of the first support protruding portions. This configuration makes it possible to further increase the number of first support protruding portions in the third direction.

(7) Another example of the molded pulp cushioning material proposed in the present disclosure accommodates at least a part of the accommodation target object. The accommodation target object has a first outer surface, two second outer surfaces, and two third outer surfaces. The first outer surface faces in a first direction. The two second outer surfaces face each other in a second direction intersecting the first direction. The two third outer surfaces face each other in a third direction intersecting the first and second directions. This molded pulp cushioning material includes a first wall and two third walls. The first wall is provided to support the first outer surface of the accommodation target object. The two third walls are provided to support the two third outer surfaces of the accommodation target object, and positioned to face each other in the third direction. A plurality of first support protruding portions protruding in the first direction are formed on the first wall. The plurality of first support protruding portions are lined up in the second direction and in the third direction. A third support protruding portion is formed on each of the two third walls. A width in the third direction of each of the plurality of first support protruding portions is smaller than 20% of a distance between the third support protruding portions formed on the two third walls. The above-described molded pulp cushioning material makes it possible to increase the number of first support protruding portions lined up in the third direction. As a result, the height of the first support protruding portions can be reduced while the shock absorption performance acting in the first direction is ensured.

(8) Still another example of the molded pulp cushioning material proposed in the present disclosure accommodates at least a part of the accommodation target object. The accommodation target object has a first outer surface, two second outer surfaces, and two third outer surfaces. The first outer surface faces in a first direction. The two second outer surfaces face each other in a second direction intersecting the first direction. The two third outer surfaces face each other in a third direction intersecting the first and second directions. This molded pulp cushioning material includes a first wall and a plurality of first support protruding portions. The first wall is provided to support the first outer surface of the accommodation target object. The plurality of first support protruding portions are formed on the first wall, and lined up in the second direction and in the third direction. A width of the first wall in the third direction is greater than a width of the first wall in the second direction. A width of each of the first support protruding portions in the third direction is equal to or smaller than a width of each of the first support protruding portions in the second direction. The above-described molded pulp cushioning material makes it possible to increase the number of first support protruding portions lined up in the third direction. As a result, the height of the first support protruding portions can be reduced while the shock absorption performance acting in the first direction is ensured.

It should be noted that the molded pulp cushioning material proposed in the embodiment of the present disclosure is not limited to the cushioning material 10 and may be variously modified.

For example, the shape and size of the first support protruding portions 11*a* may vary with the positions on the side wall 11. Further, the examples depicted, for instance, in FIGS. 2A and 2B, indicate that the first support protruding portions 11*a* are quadrilateral. However, the shape of the first support protruding portions 11*a* is not limited to a quadrilateral. For example, the side wall 11 may have the first support protruding portions 11*a* that are triangular or circular in lateral view.

It should be understood by those skilled in the art that various modifications, combinations, sub-combinations and alterations may occur depending on design requirements and other factors insofar as they are within the scope of the appended claims or the equivalents thereof.

What is claimed is:

1. A molded pulp cushioning material comprising:

a first wall including a plurality of first support protruding portions formed on the first wall and protruding in a first direction; and a second wall including a plurality of second support protruding portions formed on the second wall and protruding in a second direction intersecting the first direction, wherein;

the plurality of first support protruding portions are lined up in in a third direction that intersects the first direction and the second direction;

the plurality of second support protruding portions are lined up in the third direction; and a first distance between two first support protruding portions adjacent to each other in the second direction of the plurality of first support protruding portions and a second distance between the two first support protruding portions adjacent to each other in the third direction are smaller than a third distance between two adjacent second support protruding portions of the plurality of second support protruding portions.

2. The molded pulp cushioning material according to claim 1, wherein the first distance between the two first support protruding portions adjacent to each other in the second direction and the second distance between the two first support protruding portions adjacent to each other in the third direction are smaller than half the third distance between the two adjacent second support protruding portions.

3. The molded pulp cushioning material according to claim 1, further comprising two third walls that facing each other in the third direction, wherein:

a third support protruding portion is formed on each of the two third walls; and a width in the third direction of each of the plurality of first support protruding portions is smaller than 20% of a distance between the third support protruding portions formed on the two third walls.

4. The molded pulp cushioning material according to claim 3, further comprising two second walls facing each other in the second direction, wherein:

a second support protruding portion is formed on each of the two second walls, and a width in the second direction of each of the plurality of first support protruding portions is smaller than 30% of a distance between the second support protruding portions formed on the two second walls.

5. The molded pulp cushioning material according to claim 1, wherein:

a width of the first wall in the third direction is greater than a width of the first wall in the second direction; and a width of each of the first support protruding portions in the third direction is equal to or smaller than a width of each of the first support protruding portions in the second direction.

6. The molded pulp cushioning material according to claim 5, wherein;

a groove is formed between the two first support protruding portions adjacent to each other in the third direction; and a width of the groove is smaller than the width in the third direction of each of the first support protruding portions.

7. A molded pulp cushioning material comprising:

a first wall including a plurality of first support protruding portions formed on the first wall and protruding in a first direction, wherein:

the plurality of first support protruding portions are lined up in a second direction and in a third direction; and the second direction intersects the first direction, and the third direction intersects the first direction and the second direction; and two third walls facing each other in the third direction, wherein:

a plurality of third support protruding portions is formed on each of the two third walls; and a width in the third direction of each of the plurality of first support protruding portions is smaller than a distance between each third support protruding portion of the plurality of third support protruding portions formed along a first third wall of the two third walls.

8. A molded pulp cushioning material comprising:

a first wall facing a first direction, wherein:

the first wall includes a plurality of first support protruding portions formed on the first wall;

the plurality of first support protruding portions are lined up in a second direction and in a third direction;

the second direction intersects the first direction, and the third direction intersects the first direction and the second direction; and a first width of the first wall in the third direction is greater than a second width of the first wall in the second direction; and a third width of each of the first support protruding portions in the third direction is equal to or smaller than a fourth width of each of the first support protruding portions in the second direction.

9. The molded pulp cushioning material according to claim 1, wherein the third direction is substantially orthogonal to the first direction and the second direction.

10. The molded pulp cushioning material according to claim 7, wherein:

the two third walls includes a second third wall; and the width in the third direction of each of the plurality of first support protruding portions is smaller than 20% of the distance between a third support protruding portion of the first third wall and a third support protruding portion of the second third wall.

* * * * *